US007280081B2

(12) United States Patent
Mahr

(10) Patent No.: US 7,280,081 B2
(45) Date of Patent: Oct. 9, 2007

(54) PARABOLIC REFLECTOR AND ANTENNA INCORPORATING SAME

(75) Inventor: Ulrich Mahr, Backnang (DE)

(73) Assignee: Marconi Communications GmbH, Backnang (DE)

( * ) Notice: Subject to any disclaimer, the term of this patent is extended or adjusted under 35 U.S.C. 154(b) by 310 days.

(21) Appl. No.: 10/496,172

(22) PCT Filed: Nov. 13, 2002

(86) PCT No.: PCT/IB02/04959

§ 371 (c)(1),
(2), (4) Date: Dec. 6, 2004

(87) PCT Pub. No.: WO03/044898

PCT Pub. Date: May 30, 2003

(65) Prior Publication Data

US 2005/0083240 A1 Apr. 21, 2005

(30) Foreign Application Priority Data

Nov. 22, 2001 (EP) ..... 01127833

(51) Int. Cl.
*H01Q 13/00* (2006.01)
*H01Q 15/14* (2006.01)

(52) U.S. Cl. ..... 343/781 CA; 343/912

(58) Field of Classification Search ..... 343/781 P, 343/781 CA, 912
See application file for complete search history.

(56) References Cited

U.S. PATENT DOCUMENTS 4,513,293 A 4/1985 Stephens
4,626,863 A * 12/1986 Knop et al. ..... 343/781 P
5,973,652 A * 10/1999 Sanford et al. ..... 343/781 P
6,107,973 A * 8/2000 Knop et al. ..... 343/781 P
6,281,852 B1 8/2001 Amarillas
2001/0005180 A1 6/2001 Karlsson et al.

FOREIGN PATENT DOCUMENTS

DE 44 12 769 A1 10/1995

OTHER PUBLICATIONS

*Dielectic Feed for Dual Band Operation of Parabolic Reflector Antennas*,, U. Mahr, Eleventh International Conference on Antennas and Propagation (IEE Conf. Publ. No. 480), Proceedings of ICAP-11TH, vol. 2, Apr. 17-20, 2001, pp. 701-704.

* cited by examiner

*Primary Examiner*—Shih-Chao Chen
(74) *Attorney, Agent, or Firm*—Kirschstein, et al.

(57) ABSTRACT

A parabolic reflector for an antenna has a plurality of concentric annular sections arranged in series from a first annular section nearest a central axis of the reflector to a last annular section defining an outer perimeter of the reflector. Each section has a parabolic reflecting surface between inner and outer perimeters. The sections are configured such that the focal point associated with at least the last section lies inside an internal volume of the reflector and are arranged with respect to each other along the central axis, such that an overall depth of the reflector is substantially minimized. The inner perimeters of all the sections are preferably arranged to lie substantially on a plane which is perpendicular to the central axis. The outer perimeter of each section except the last section is preferably connected with the inner perimeter of the succeeding section by means of an annular strip. The strips may either each have an angle of inclination to the reflector central axis of between 0° and 3° or they may lie on respective cones running from the respective inner perimeters of the respective sections to which they are joined, to the furthest located focal point or ring.

9 Claims, 2 Drawing Sheets

PARABOLIC REFLECTOR AND ANTENNA INCORPORATING SAME

BACKGROUND OF THE INVENTION

In many communications systems space is at a premium and therefore efforts are made to make antennas as compact as possible, while retaining adequate performance characteristics. In point-to-multipoint (PMP) microwave radio links especially, flat antennas are often installed in the terminal units due to their compact design. They can be easily integrated into boxes containing the electrical equipment of the outdoor units without detracting from the quality of the urban environment. For medium-gain requirements printed antennas are preferred. These have an upper gain limit of about 30 dB, due to the fact that the conductor losses in the associated feed networks increase considerably with antenna size. An alternative solution for higher gain are waveguide slot arrays, which have low losses but higher production costs. Hybrid configurations are also feasible using a mixed design with microstrip subarrays and a central waveguide feed network. In the case of dual polarization either a stacked design or two single polarized antennas side-by-side are necessary. All these antennas are more complicated than the simple printed array and require additional volume and thickness which is further increased by the presence of the radome, a flat dielectric plate placed a distance of approximately one wavelength above the antenna parallel to the array surface.

Examples are given in the existing literature of flat or parabolic reflectors with parallel metallic rings placed λ/4 above a metallic surface (zone-plate antennas)—see, for example, L. F. van Buskirk and C. E. Hend, "The Zone Plate as a Radio-Frequency Focusing Element", IRE Transactions on Antennas and Propagation, vol. AP-9, No. 3, May 1961, pp 319-320; P. Cousin, G. Landrac, S. Toutain and J. J. Delmas, "Calcul de la Distribution de Champ Focal et du Diagramme de Rayonnement d'une Antenne Parabolique a Zones de Fresnel", Journees Internationales de Nice sur les Antennes, Nice, November 1994, pp 489-492; Y. J. Guo, S. K. Barton, "Analysis of One-Dimensional Zonal Reflectors", IEEE Transactions on Antennas and Propagation, vol. AP-43, No. 4, April 1995, pp 385-389. Also printed flat reflectors are known from, e.g., Y. J. Guo and S. K. Barton, "A High-Efficiency Quarter-Wave Zone-Plate Reflector", IEEE Microwave and Guided-Wave Letters, vol. 2, No. 12, December 1992, pp 470-471.

A further example, which is illustrated in FIG. 1, involves the use of a parabolic reflector 10 in association with a subreflector 11, a dielectric cone 12 and a waveguide feed-section 13. In use signals to be transmitted from the antenna are fed into the waveguide 13 at the apex 14 of the reflector, are propagated along the waveguide and are carried through the dielectric cone 12 to the reflecting surface 15 of the subreflector 11, where they are reflected through the dielectric of the cone 12 onto the inner surface of the main reflector 10, being finally reflected from that surface out into free space in the same direction as the initial feed wave entering the apex 14. The dielectric cone 12 helps to ensure a correct illumination pattern on the main reflector 10. A step-transformer 16 may also be included in order to minimize unwanted back-reflections along the waveguide 13.

Two further aspects of this known design result in a considerable thickness of the entire antenna in the plane of the page. Firstly, a radome 17 is included, which is necessarily spaced a certain distance away from the main reflector 10—i.e. by at least λ/2 where a planar array is concerned.

(The example shown in FIG. 1 is intended for point-to-point links, which have to meet more severe restrictions of the radiated power in large angular regions than a terminal antenna in a PMP application. This is achieved with the aid of a deep rim whose inner surface is coated with absorbing material. Consequently the very large distance of the radome from the reflector in FIG. 1 would not be required in the PMP setting currently being considered).

Secondly, the focal length of the reflector 10 requires that the subreflector 11 be placed that same distance away from the apex 14, having as a further consequence the considerable length of the feed-waveguide 13. As a result, therefore, the thickness of the entire antenna amounts to approximately 16λ (assuming an operating frequency of around 32 GHz). Furthermore, the great length of the waveguide may increase the overall return-losses in a broadband system.

SUMMARY OF THE INVENTION

In accordance with a first aspect of the invention there is provided a parabolic reflector for an antenna comprising: a plurality of concentric annular sections arranged in series from a first annular section nearest a central axis of the reflector to a last annular section defining an outer perimeter of the reflector, each section having a parabolic reflecting surface between inner and outer perimeters, characterised in that the sections are configured such that the focal point or focal ring associated with at least the last section lies inside an internal volume of the reflector and are arranged with respect to each other along the central axis, such that an overall depth of the reflector is minimised or near-minimised. By ensuring that the focus of the reflector lies inside its internal volume this ensures that the overall depth of an antenna incorporating such an reflector is minimised since an antenna subreflector, which is positioned at the focus, will lie within the volume of the reflector.

Advantageously the inner perimeters of all the sections are arranged to lie substantially on a plane which is perpendicular to the central axis. Such an arrangement assists in minimising the depth of the reflector.

Preferably the outer perimeter of each section, except the last section, is connected with the inner perimeter of the succeeding section by means of an annular strip.

In one arrangement the annular strips have an angle of inclination to the central axis which is substantially the same for all the strips. Preferably the angle of inclination lies between values 0 and 3°.

In an alternative preferred arrangement each strip lies on a respective imaginary cone or frustrocone joining the inner perimeter of the respective section, to which the strip is attached, to the focal point or focal ring of the reflector.

Preferably the focal lengths (fi) of the parabolic sections follow the rule:

$$fi=fi-1+k.1/2$$

where fi=focal length; k=1, 2, 3 . . . ; i=2, . . . N; l=mean operating wave-length of the reflector.

According to a second aspect of the invention there is provided an antenna comprising a reflector as described above; a dielectric cone and subreflector lying along the common axis of the reflector; a waveguide feed section passing through an apex of the reflector defined by the inner perimeter of the first section and communicating with the dielectric cone; and a radome.

Preferably the focal point or focal ring of the reflector lies on a reflecting surface of the subreflector, the subreflector lies within the internal volume of the reflector and the radome abuts the outermost perimeter of the reflector.

Advantageously the antenna further comprising a transformer section disposed between the reflector apex and the dielectric cone.

BRIEF DESCRIPTION OF THE DRAWINGS

Embodiments of the invention will now be described, by way of non-limiting example only, with reference to the drawings, of which.

DETAILED DESCRIPTION OF THE PREFERRED EMBODIMENT

Figure 2:
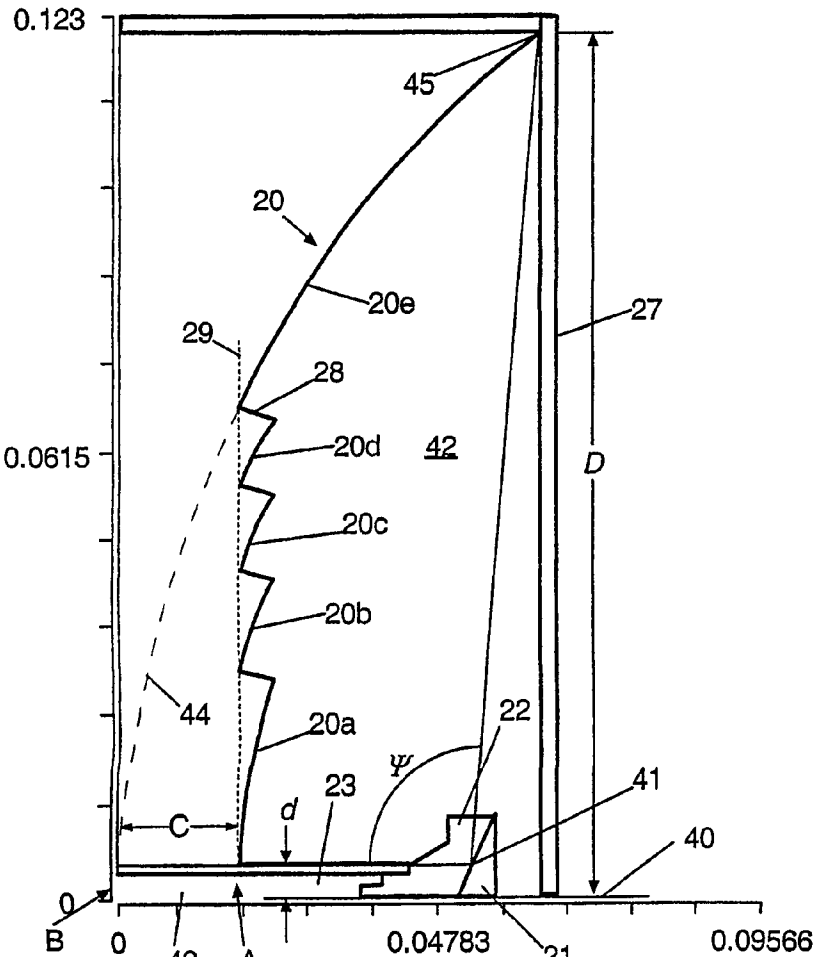

Referring now to FIG. 2, an embodiment of an antenna according to the present invention is shown, comprising as before a main reflector 20, a subreflector 21, a dielectric cone 22, a waveguide section 23 and a radome 27. This time, however, the reflector 20 is a multi-stage antenna, consisting of a plurality N of concentric annular sections 20*a*-20*e* (N=5 in this example) which are connected to each other via concentric annular strips 28. Each of the sections 20*a*-20*e* has a reflecting surface that is parabolic in a radial direction. The strips 28 connect the outer perimeters of the various sections (except the last section 20*e*) to the inner perimeters of the succeeding sections, there being formed thereby a continuous inner reflecting surface of the main reflector 20. The inner perimeter of the first section 20*a* forms part of the apex of the reflector 20, while the outer perimeter of the last section 20*e* forms the outer perimeter of the entire reflector 20.

In the illustrated preferred embodiment all the inner perimeters of the annular sections, is 20*a*-20*e* lie on a plane 29 running perpendicular to the central axis 40 of the antenna. In practice however each section could lie on one of a number of planes which are disposed along the axial 40 without affecting the performance of the antenna too adversely. Of course, if they do not lie on a plane this will result in a correspondingly greater depth (in an axial direction) of the antenna, which is clearly undesirable, although it is possible that a slight forward inclination of the inner-perimeter plane towards the antenna aperture may reduce the shadowing effect of the strips, thereby improving performance somewhat. The various parabolic sections in the illustrated embodiment preferably have slightly different focal lengths, that of the last section 20*e* having the largest focal length, that of the first section 20*a* the smallest. More precisely the focal lengths preferably follow the rule:

$$f_i=f_{i-1}+k.\lambda/2$$

where $f_i$=focal length; k=1, 2, 3 . . . ; i=2, . . . N; λ=mean operating wave-length of the reflector. In FIG. 2, k=1 and the focal ring of the last section 20*e* is shown at 41. Ideally all the foci of the parabolic sections coincide at 41, though in an optimisation of the design it may be possible to incorporate small deviations of the individual foci so as to account for non-spherical effects in the near field of the radiating element.

Figure 1:
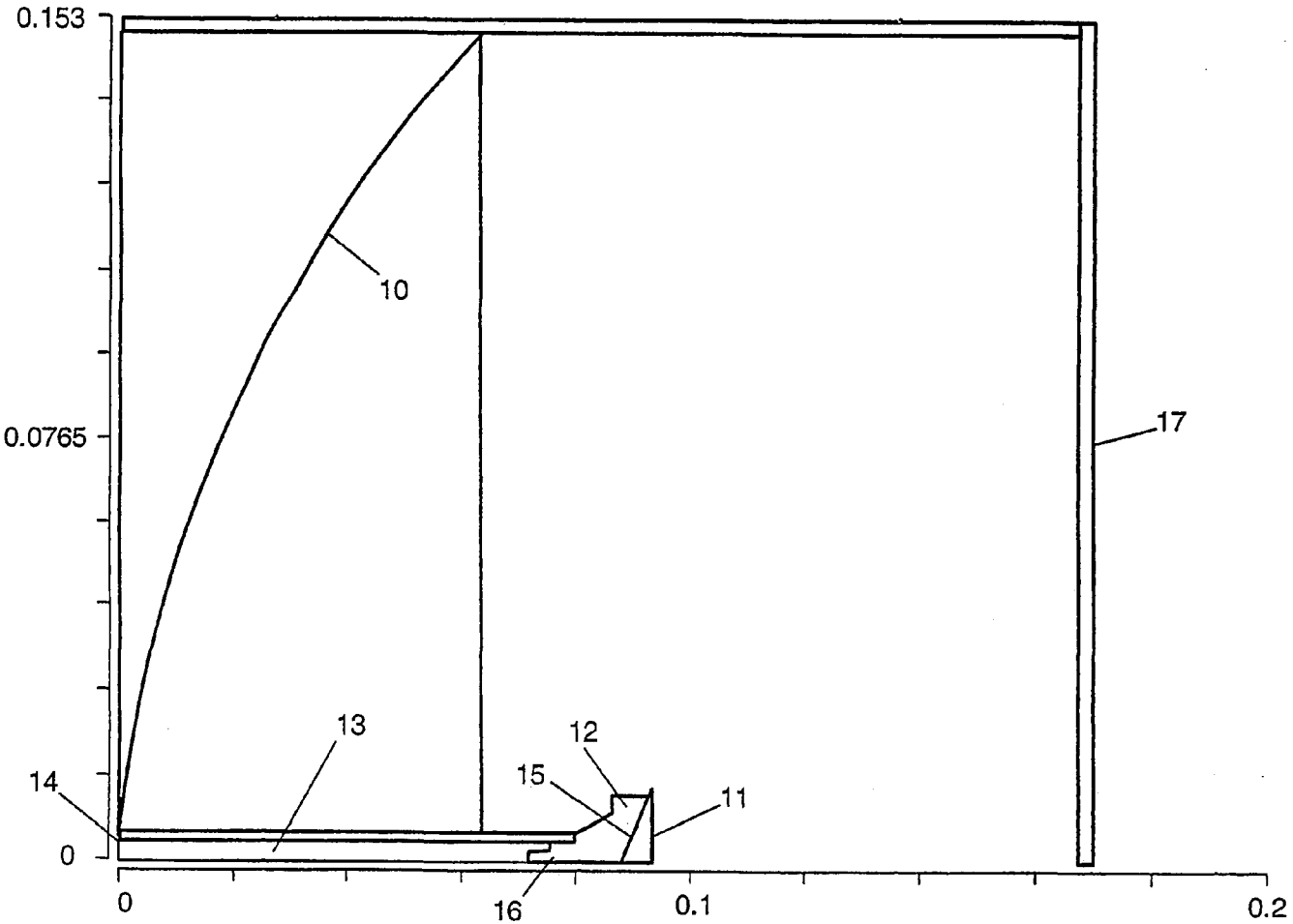
Fig 1 PRIOR ART
FIG. 1 is a section through a known parabolic-reflector antenna (half-rotational section only)

A second difference between this antenna and that shown in, for example, FIG. 1, is that in the inventive antenna the angle Ψ subtended by the reflector 20 is at least 90°—in FIG. 2 it is approximately 95°. In terms of the whole antenna and reflector, this amounts to a total angle of 190°. Such a large angle allows the whole of the subreflector/feed arrangement to be accommodated fully within the internal volume 42 of the reflector, thereby shortening the waveguide feed 23. A further reduction is created by the use of the strips 28, the otherwise normal length being indicated by the additional waveguide portion 43 which meets the apex of the otherwise conventional uniformly parabolic antenna 44 (see dotted line extension of last section 20*e*). In other words, the apex of the reflector in the current invention is located at A, while that of the conventional antenna system is located at B. Clearly there is a considerable saving in thickness of the entire antenna, which is further enhanced by the fact that now the radome can be positioned much closer to the reflector rim 45 than in the known arrangement of FIG. 1, even—since now the feed network is fully within the volume 42 of the reflector—right up to and abutting the rim 45 itself. (The minimum λ/2 spacing mentioned earlier in connection with planar arrays does not apply to single-fed reflector antennas).

There is thus a double saving in antenna thickness made possible by the invention: firstly, and most fundamentally, the saving of the additional length of waveguide C (see FIG. 2) due to the use of the strips 28; secondly, the possibility of reducing the spacing of the radome 27 from the reflector, due to the very large subtended angle Ψ, which allows the subreflector to be contained fully within the internal volume 42 of the antenna.

The various dimensions of the FIG. 2 antenna are as follows:

- Outer diameter (D)=240 mm
- Inner diameter (d—corresponds to outside diameter of waveguide)=9.30 mm
- Opening angle (2Ψ)=190°
- Depth (without strips) (Tmax=(D-d)/4.tan(Ψ/2))=62.94 mm
- Depth (with strips)=44.90 mm
- Waveguide length is given by $L<(D/4-(N-1).\lambda_0/2)$, where $\lambda_0$ is wavelength in free space at centre frequency (in the lower band where the antenna is a dual-band antenna—see later).

As already mentioned, the number of stages, N, is variable, as is also the value of k, though for a given outer diameter D, inner diameter d and opening angle 2Ψ not all combinations of N and k are possible. Table 1 below gives the gain figures for N=1-7 and k=1 or 2 for three operating frequencies. The overall depth is also specified. As can be seen from the table, doubling k results in the need for only three stages (strips) instead of five for the same overall depth; however, for that same depth there is a sacrifice of between 0.4 and 0.9 dB, depending on the frequency chosen, when fewer stages are employed. The reduction in depth is 29% in both cases. Efficiency is around 53% for the k=1 case instead of 56% for the equivalent simple uniform reflector design. In both cases the reflection factor is less than −14 dB.

As regards the strips 28, these have a very shallow angle of inclination to the central axis 40 of the antenna; indeed, the angle may be zero, though where the reflector body is to be manufactured by a pressing or moulding process, the angle may amount to a few degrees, e.g. 2 or 3°.

A further advantage of the design is that the amplitude of the first sidelobe of the far-field characteristic is reduced in comparison with the behaviour of the conventional antenna with simple, uniform reflector, although this reduction is only apparent over a narrow band and does not apply to the whole frequency band.

Figure 3:
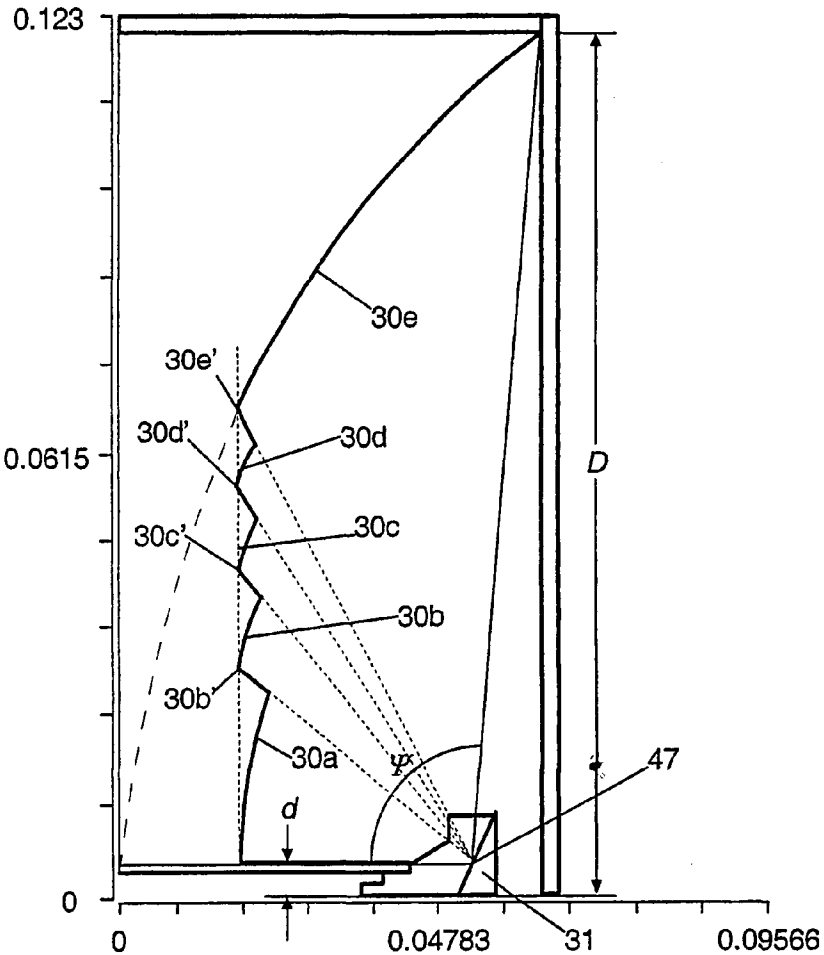
FIGS. 2 and 3 are sections through two embodiments of a parabolic-reflector antenna in accordance with the present invention.

A second embodiment of the invention is illustrated in FIG. 3. In FIG. 3, instead of the strips 28 being essentially parallel to the central axis 40 of the antenna they are angled so as to lie in each case on an imaginary cone (or frustrocone) running from the respective inner perimeters 30*b*'-30*e*' to the focal ring 47 on the subreflector. It is assumed here that the various parabolic sections 30*a*-30*e* have similar respective focal-lengths to the sections 20*a*-20*e* in FIG. 2. The purpose of this measure is to ensure that less shadowing or obscuring of the sections takes place vis-à-vis the radiation reflected from the subreflector 31. The FIG. 2 embodiment, by contrast, involves a greater amount of shadowing, which in itself impairs the performance of the antenna. Other factors affecting the gain may enter here, however, and reduce the advantages this embodiment ought in theory to deliver—e.g. there will be wave diffraction at the strips shown in FIG. 2 which may well in practice lift the gain, thereby offsetting the gain penalty caused by the greater shadowing.

Both embodiments are suitable for dual polarization, and to achieve this an orthomode transducer (not shown) may be included at the input of the waveguide feed shown in the drawings (FIGS. 2 and 3). In addition the antenna may be used in a dual-band configuration—i.e. with two frequency-bands separated by an octave—provided an appropriate feed arrangement is employed.

TABLE 1

| | | Gain (dB) | | | | | | |
|---|---|---|---|---|---|---|---|---|
| | | N = 1 | N = 2 | N = 3 | N = 4 | N = 5 | N = 6 | N = 7 |
| k = 1 | 31.82 (GHz) | 35.53 | 35.48 | 35.33 | 35.32 | 35.35 | 34.82 | 32.88 |
| | 32.60 (GHz) | 36.29 | 36.26 | 36.22 | 36.17 | 35.78 | 35.08 | 33.66 |
| | 33.38 (GHz) | 36.37 | 36.34 | 36.33 | 36.09 | 35.79 | 35.59 | 34.59 |
| | Depth (mm) | 62.94 | 58.43 | 53.92 | 49.41 | 44.90 | 40.39 | 35.88 |
| k = 2 | 31.82 (GHz) | 35.53 | 35.15 | 34.43 | — | — | — | — |
| | 32.60 (GHz) | 36.29 | 36.08 | 35.42 | — | — | — | — |
| | 33.38 (GHz) | 36.37 | 36.16 | 35.18 | — | — | — | — |
| | Depth (mm) | 62.94 | 53.92 | 44.90 | — | — | — | — |

The invention claimed is:

1. A microwave reflector antenna, comprising: a parabolic main reflector; a waveguide feed section passing through an apex of, and lying along a central axis of, the main reflector; a dielectric cone and a subreflector in communication with the waveguide feed section; the main reflector including a plurality (N) of concentric annular sections arranged in series from a first annular section nearest the central axis of the main reflector to a last annular section defining an outer perimeter of the main reflector, each section having a parabolic reflecting surface between inner and outer perimeters, and a focal point or focal ring associated with each section lying on a reflecting surface of the subreflector, the sections being configured such that the focal point or focal ring associated with each section lies inside an internal volume of the main reflector and is arranged with respect to each other along the central axis, such that an overall depth of the main reflector is decreased; and the subreflector lying within the internal volume of the main reflector.

2. The antenna according to claim 1, wherein the inner perimeters of all the sections are arranged to lie substantially on a plane which is perpendicular to the central axis.

3. The antenna according to claim 1, wherein the outer perimeter of each section, except the last annular section, is connected with the inner perimeter of the succeeding section by means of an annular strip.

4. The antenna according to claim 3, wherein each annular strip has an angle of inclination to the central axis which is substantially the same for all the strips.

5. The antenna according to claim 4, wherein the angle of inclination lies between values of 0° and 30°.

6. The antenna according to claim 3, wherein each strip lies on a respective imaginary cone or frustrocone joining the inner perimeter of the respective section, to which the strip is attached, to the focal point or focal ring of the main reflector.

7. The antenna according to claim 1, wherein focal lengths ($f_i$) of the parabolic reflecting surfaces of the annular sections follow the rule:

$$f_i = f_{i-1} + k\lambda/2$$

where $f_i$=focal length;

k=1, 2, 3 . . . ;

i=2, . . . N; and

λ=mean operating wavelength of the reflector.

8. The antenna according to claim 1, and further comprising a radome that abuts the outermost perimeter of the main reflector.

9. The antenna according to claim 1, and further comprising a step-transformer section disposed between an apex of the subreflector and the dielectric cone for minimizing back-reflections along the waveguide feed section.

* * * * *

UNITED STATES PATENT AND TRADEMARK OFFICE

CERTIFICATE OF CORRECTION

PATENT NO. : 7,280,081 B2
APPLICATION NO. : 10/496172
DATED : October 9, 2007
INVENTOR(S) : Mahr It is certified that error appears in the above-identified patent and that said Letters Patent is hereby corrected as shown below:

In Column 3, Line 39, after “sections,” delete “is”.

In Column 6, Line 28, in Claim 5, delete “30°.” and insert -- 3°. --, therefor.

In Column 6, Line 43, in Claim 7, delete “the reflector.” and insert -- the main reflector. --, therefor.

Signed and Sealed this

Tenth Day of February, 2009

JOHN DOLL
*Acting Director of the United States Patent and Trademark Office*